United States Patent [19]

Niblock

[11] Patent Number: 4,629,077

[45] Date of Patent: Dec. 16, 1986

[54] SHELF SUPPORT SYSTEM

[76] Inventor: George W. Niblock, 1059 Upper State Rd., Chalfont, Pa. 18914

[21] Appl. No.: 725,269

[22] Filed: Apr. 19, 1985

[51] Int. Cl.[4] ..... A47B 47/00

[52] U.S. Cl. ..... 211/187; 108/144; 403/344; 403/290

[58] Field of Search ..... 211/188, 181, 187; 108/144, 106; 248/246, 244, 188; 403/344, 290

[56] References Cited

U.S. PATENT DOCUMENTS

| | | | |
|---|---|---|---|
| D. 215,773 | 10/1969 | Maslow . | |
| 786,587 | 4/1905 | Morgan et al. . | |
| 915,002 | 3/1909 | Werner . | |
| 2,388,056 | 10/1945 | Hendricks . | |
| 2,705,119 | 3/1955 | Ingwer . | |
| 3,138,123 | 6/1964 | Maslow . | |
| 3,180,288 | 4/1965 | McCowan . | |
| 3,208,406 | 9/1965 | Maslow . | |
| 3,208,408 | 9/1965 | Maslow . | |
| 3,208,777 | 9/1965 | Maslow . | |
| 3,225,720 | 12/1965 | Maslow . | |
| 3,245,365 | 4/1966 | Doherty . | |
| 3,316,864 | 5/1967 | Maslow . | |
| 3,344,756 | 10/1967 | Kelson . | |
| 3,424,111 | 1/1969 | Maslow | 108/144 |
| 3,523,508 | 8/1970 | Maslow . | |
| 3,604,369 | 9/1971 | Maslow . | |
| 3,675,598 | 7/1972 | Kesilman et al. . | |
| 3,687,092 | 8/1972 | Manning . | |
| 3,741,514 | 6/1973 | Snurr . | |
| 3,757,705 | 9/1973 | Maslow . | |
| 3,874,511 | 4/1975 | Maslow | 108/144 X |
| 4,128,064 | 12/1978 | Chung et al. | 248/188 X |
| 4,138,953 | 2/1979 | Tashman . | |
| 4,318,352 | 3/1982 | Friedman et al. . | |
| 4,444,125 | 4/1984 | Welsch et al. . | |

FOREIGN PATENT DOCUMENTS

| | | |
|---|---|---|
| 264047 | 11/1967 | Austria . |
| 1129377 | 8/1982 | Canada . |
| 2729880 | 1/1979 | Fed. Rep. of Germany . |
| 855715 | 5/1940 | France . |

OTHER PUBLICATIONS

Equipto—"Wire Shelving, Cards and Racks", ©1984.

Gillis Associates Inc.—(Selected pages from catalog), 1984.

InterMetro Industries Corporation—"Food Service Equipment Digest", 1981.

*Primary Examiner*—Ramon S. Britts

*Assistant Examiner*—Blair M. Johnson

*Attorney, Agent, or Firm*—Cushman, Darby & Cushman

[57] ABSTRACT

A shelving system with an improved shelf to post support assembly that permits the support of heavy shelf loadings, yet easy separation of the support assembly as well as an elimination of racking. The support assembly, positioned at each corner of each shelf, includes a one piece, split ring insert member and a corner section fixed to the shelf. The insert member is independently positioned on the post at a desired position and is comprised of an upper portion having a cylindrically shaped wall section defining a substantially cylindrical interior bore and a cylindrical outer wall. The lower section is radiused outwardly beyond the outer cylindrical wall and the interior bore extends therethrough and includes a radially inwardly directed rib. The corner section has a through bore including upper and lower cylindrical wall sections, the lower having a greater diameter with a chamfered surface serving to connect the upper and lower sections together. The top end of the upper section is tapered inwardly to define an opening substantially equal to, but not greater than the outer diameter of the insert member's cylindrical wall section and the diameter of the upper and lower cylindrical bores are each greater than the outer diameters of the cylindrical and radiused portions of the insert. When assembled, the chamfered surface will engage the radiused portion of the insert, the top opening of the corner section will engage the insert and each will be spaced from the other along the remaining adjacent wall sections.

16 Claims, 15 Drawing Figures

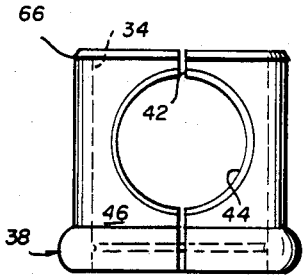
FIG. 5
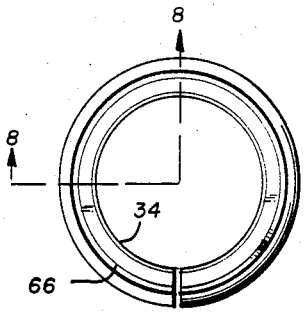
FIG. 6
FIG. 7
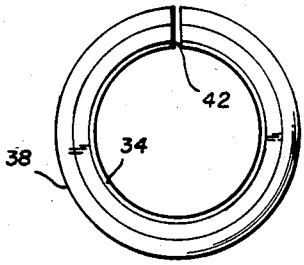
FIG. 8
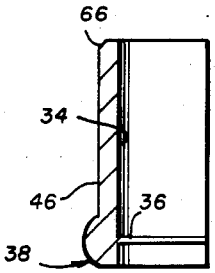
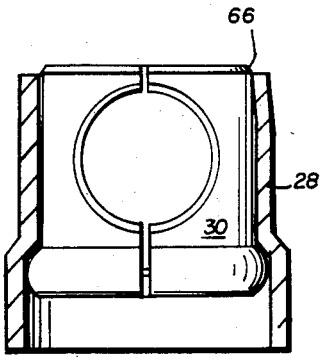
FIG. 9

SHELF SUPPORT SYSTEM

FIELD OF THE INVENTION

The present invention relates to an adjustable shelving system, including a plurality of grooved support posts and individual pieces of shelving, wherein each shelf includes a support system at each corner that cooperates with the posts to provide positive support under load conditions, easy maneuverability in initially assembling the shelving system and in repositioning or moving the shelf to another position on the posts, and further where racking of the assemblied shelving system is prevented.

BACKGROUND OF THE PRESENT INVENTION

There have been many approaches suggested for preparing shelving systems, particularly for industrial purposes. Such shelving systems have generally attempted to produce shelving that is easily adjustable or able to be knocked down with relative ease while at the same time providing sufficient support to accept relatively heavy loads, especially those that industrial shelving can often be subjected to. However, many of these systems have not achieved these desired goals.

An early example of a shelf mounting structure is shown in Doherty, U.S. Pat. No. 3,245,365. This structure was comprised of a solid, cylindrical sleeve provided midway along each side of the shelf that would fit over a support post. Each sleeve included a longitudinally extending groove or notch formed in the interior side wall for receiving a spring type locking member that would be insertable in that groove so that a toothed edge provided on the bottom end of the spring member would extend below the sleeve member and engage the post. In that position, when the sleeve was placed over the locking member, or vice versa, and load applied to the shelf, would force the toothed edge toward the pole thereby locking the shelf in the desired position.

Thereafter, the art seemed to develop about the concept of using two engaging wedge shaped or frusto conical surfaces and the use of an insert member that would fit against or over the post and provide one of those wedge or frusto-conical surfaces. In the frusto conical systems, the insert was provided with a cylindrically shaped interior opening that would ride along the post and a frusto conical exterior surface. A separate support structure mounted on, within or to the shelf structure was provided with a complementary frusto conically shaped internal bore so that when the support structure was placed over the insert and the two frusto conical sections were joined, the pair would mate along their entire length with those mating surfaces providing the support for the shelf. Exemplary of this frusto conical approach are U.S. Pat. Nos. 3,424,111, 3,675,598, 3,757,705, 3,874,511, 4,318,352, and 4,444,125.

In U.S. Pat. No. 3,424,111, Maslow, a two-piece frusto conical insert member also included an exterior groove for receiving an O-ring for holding the insert member comprised of two halves that would fit together and in place about the post. The insert member also included a radially inwardly directed rib on the inner surface for mating with one of the grooves provided on the post. Support for the shelf was provided by the mating of the two frusto conical surfaces, one on the exterior of the insert, the other in the form of a frusto conical bore within a support member fixed to the shelf. After being loaded, separation of the support system elements would sometimes prove difficult because of the total surface engagement and the wedging action between those two frusto conical surfaces. It should be noted that the two piece insert construction had a tendency when struck, as when moving the shelving, to actually pop apart or separate and fall off the post causing assembly or shelf movement problems.

Rather than using the internally directed rib, the U.S. Pat. No. 3,675,598 approach was to hold the insert member in place with a set screw, positioned in a collar at the lower end of the insert.

In U.S. Pat. No. 3,757,705, a C-clip was placed about the two halves of the insert but this occurred following placement of the frusto conically shaped sleeve type corner support thereover. The C-clip would retain the corner support in position on the insert member and on the post. The corner support was a split sleeve structure so as to provide some elastic lateral expansion with the C-shaped ring, provided at the top of the two halved insert able to resist inadvertent uplifting of the shelf.

In U.S. Pat. No. 3,874,511, the two piece frusto conical insert is again used. The shelf has a frusto conically shaped opening at each corner, and the insert member included an annular lip at its base which assisted in limiting downward movement of the corner member. Primary support for the shelf, however, continued to be provided by the pair of mating frusto conical surfaces.

Tashman, U.S. Pat. No. 4,138,953, also uses the mating frusto conical surface approach, but rather than using a two piece insert member, Tashman provides a one piece, split ring tapered member that also incorporates the interior rib for positioning that insert member on the post.

In Maslow, U.S. Pat. No. 3,604,369, the thought behind the support technqiue was again directed at a wedge concept. Rather than employing mating frusto conical surfaces, a simple wedge member, provided with a plurality of inwardly directed curved bosses, graduated so as to mate with similar female bosses in the post, would be placed on the post. A sleeve member, provided with a tapered or angled slot in the form of a key way for receiving the tapered wedge, would then be slid down the post and over the wedge with the wedge serving to hold the sleeve in position on the post.

French Pat. No. 855,715, employs a sleeve that is also positioned at the center point of the side of a shelf, and is provided along most of its interior with a cylindrical surface. The bottom portion tapers outwardly away from the post in the form of a frusto conical portion. A rubber O-ring is positioned on the post, although not positively as it can move along the post even prior to being deformed. The O-ring is received in this frusto conical portion in the lower half of the sleeve. As load is placed on the shelf, however, the O-ring will be compressed or deformed in between the sleeve and the post under load conditions so that it does not provide a positive stop structure.

Chung et al, U.S. Pat. No. 4,128,064, employs two threadedly mating sections, the innermost having an inwardly directed rib to again mate with a groove provided in the post with the threaded sections serving to clamp the shelf therebetween.

Finally, Kelson, U.S. Pat. No. 3,344,756, shows the use of set screws to hold a corner support member on a post and Hendricks, U.S. Pat. No. 2,388,056; Ingwer, U.S. Pat. No. 2,705,119, and Snurr, U.S. Pat. No. 3,741,514, show the use of hardened ball bearings in various approaches to both support and allow for adjustability in a support structure.

SUMMARY OF THE PRESENT INVENTION

The present invention has as its primary objective, the providing of a positive step support structure that is easily disengageable, far more so than when employing pairs of mating frusto conical surfaces and at the same time, a support system that will support great loads and yet is itself easily adjustable along the length of a support post.

The shelving system according to this invention, as is conventional, employs a plurality of posts and each shelf includes a corner support member welded or otherwise permanently fixed at each corner. The shelving according to the present invention is preferably open wire shelving in an effort to make the shelves relatively light and easily handleable although other shelving constructions such as solid or perforated sheets could also be used. The shelving is preferably formed from stainless steel, or steel coated with an epoxy or a nickle-chrome coating.

Each corner support member connected at each of the four corners of each shelf is comprised of a generally cylindrical member having a hollow interior formed with an upper cylindrical bore with a first diameter and a lower cylindrical bore having a second and greater diameter. The two inner cylindrical bores or openings are connected together by a chamfered surface that will act as the shelf's load support surface. The upper or top end of the corner support member, specifically the upper third or quarter thereof, tapers inwardly so that the interior diameter of the opening at top of each corner support member has a diameter which is smaller than the diameter of the cylindrical portion therebelow and is substantially the same as or not larger or greater than the size of the outer diameter of the insert discussed below.

The support system also includes an insert member that is positioned between the post and the corner support. The insert member includes in a radially, inwardly directed rib to mate with one of the plurality of grooves provided on each support post. Once the insert member is appropriately positioned on the post, the corner support will be slid down the post and into place over that insert.

The insert itself includes an upper portion that has cylindrically shaped interior and exterior side wall surfaces and a radiused bottom portion integrally formed at the base of the insert so that the radiused portion extends outwardly beyond the periphery of the cylindrical exterior side walls thereabove. Preferably the inwardly directed rib is positioned in a plane parallel with the center of the radiused lower portion.

When the shelf and its four corner supports are placed over the posts, with the corner supports in position on each of their respective insert members, the chamfered surface on the inside of the corner support will engage and be positively stopped and supported by the radiused portion at the base of the insert member. While the outer diameter of the insert member is smaller than the inner diameter of the upper cylindrical bore within the corner support, the interior diameter of the opening at the upper end of the corner support is substantially identical to, but not greater than the outer diameter of the insert. When the chamfered surface is resting on and supported by the radiused lower portion of the insert, the insert will extend a slight distance above the top of the corner support and will be engaged by the opening at the top end thereof.

In this way, the radiused lower portion provides the positive stop and the load support for the shelf, with some of that load being directed inwardly to the inwardly extending rib. The engagement between the opening at the top of the corner support and the outer cylindrical surface of the insert member cooperate to lock those portions together and prevent racking. Because the remaining adjacent surfaces between the insert and the insert member in the outer corner support are spaced from one another, the shelf is readily removable regardless of the load that it had previously been placed on the shelf.

Other objects, features, and characteristics of the present invention as well as the methods and operation and functions of the related elements of the structure, and to the combination of parts and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIG. 5 is a front, elevational view of the supporting inserting member according to the present invention;

FIG. 6 is a top, plan view of the insert shown in FIG. 5;

FIG. 7 is a bottom, plan view of the insert shown in FIG. 5;

FIG. 8 is a partial, cross-sectional view through the side wall of the insert member taken along lines 8—8 in FIG. 6;

FIG. 9 is a partial, cross-sectional view of the corner section mounted in place over the insert with the corner section being shown in cross-section;

DETAILED DESCRIPTION OF THE PREFERRED EXEMPLARY EMBODIMENT OF THE PRESENT INVENTION

Figure 1:
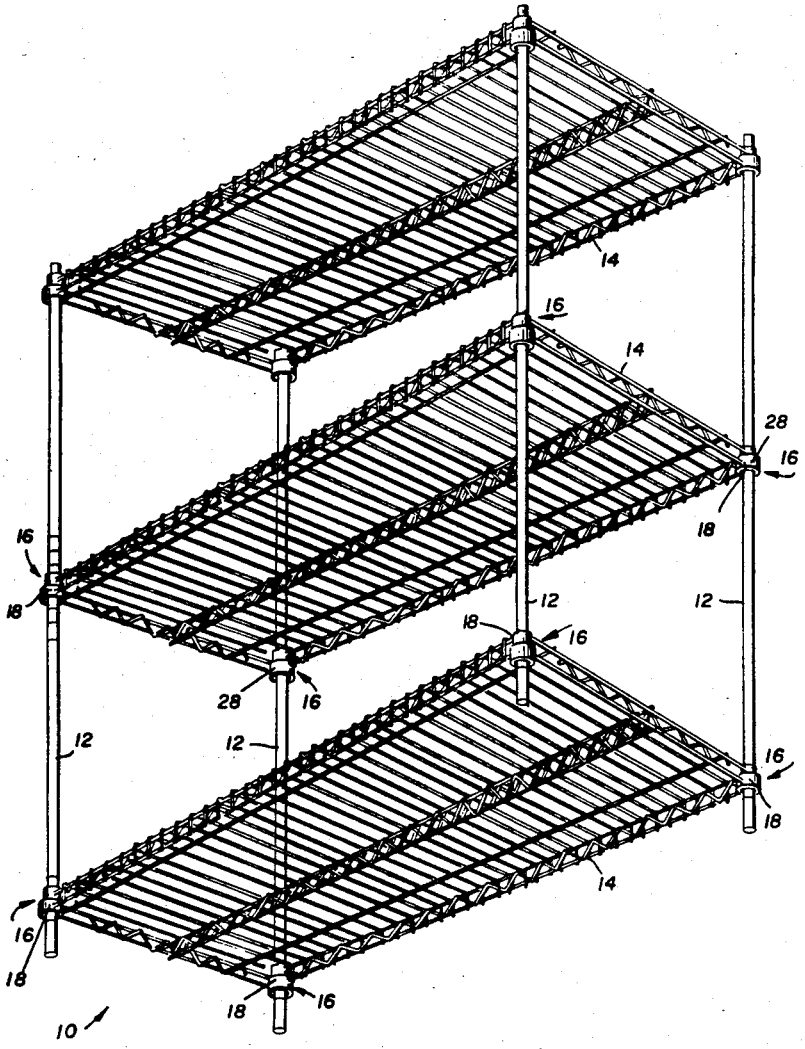
FIG. 1 is a perspective view of a shelving unit including the mounting system according to the present invention.
Figure 2:
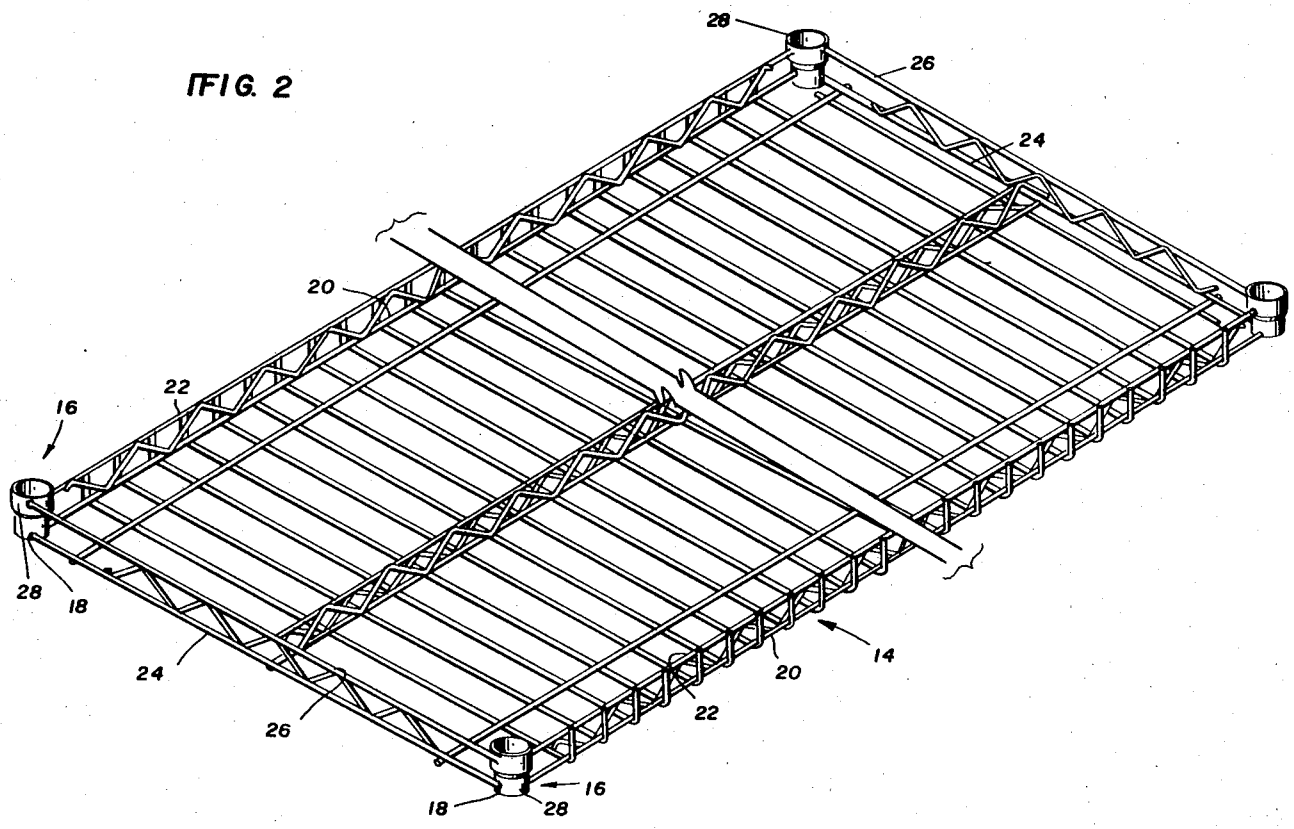
FIG. 2 is a perspective view of the bottom of a shelf according to the present invention as shown in FIG. 1.

Turning our attention first to FIG. 1, the shelving system is generally indicated at 10 and is comprised of four posts 12 and a plurality of shelves 14 connected thereto. Each shelf 14 includes a corner assembly generally, indicated at 16 being preferably welded to the shelf such as by welds generally indicated at 18.

Shelves 14 are preferably comprised of an open wire network including two parallel wires 20 and 22 in the front and a pair at each side indicated at 24 and 26. Each of the wires 20 and 22 and 24 and 26 are suitably welded as indicated to a corner support member 28 which forms part of the corner assembly 16. The corner assembly also includes an insert member 30 integrally molded from a suitably strong material, such as nylon, nylon 6, nylon 6/6, ST 801 or any other hard, moldable plastic material.

Figure 3:
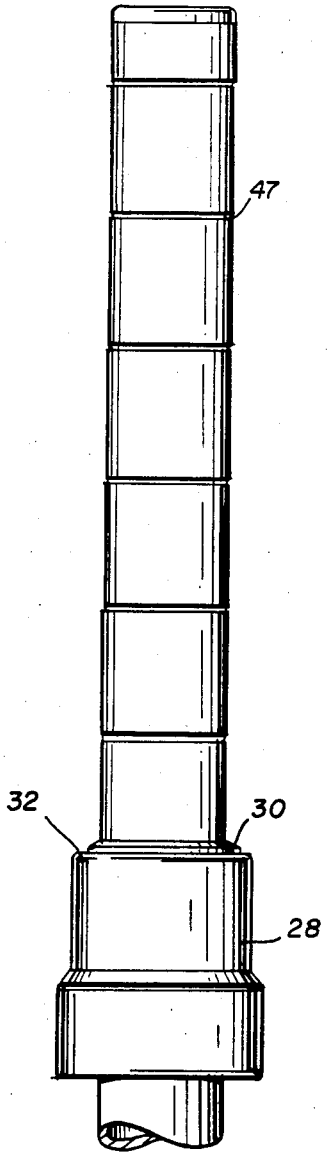
FIG. 3, is an enlarged, front, elevational view of a portion of a post support assembly mounted thereon in an assembled condition.
Figure 4:
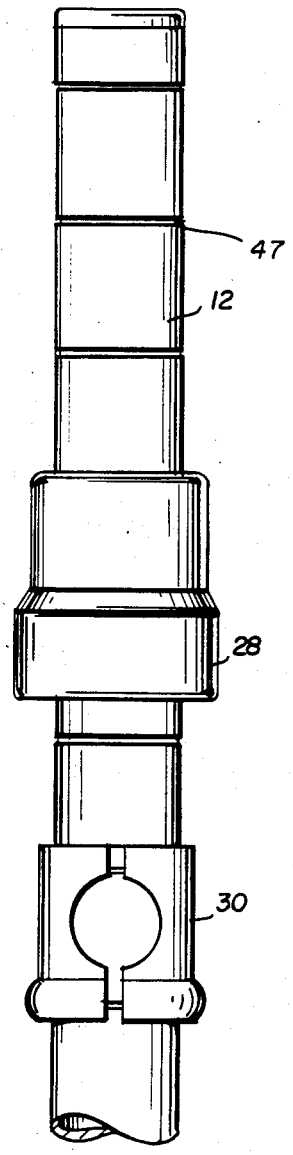
FIG. 4 is a view similar to that of FIG. 3 but with the corner support member being raised on the post off of the insert.
Figure 10:
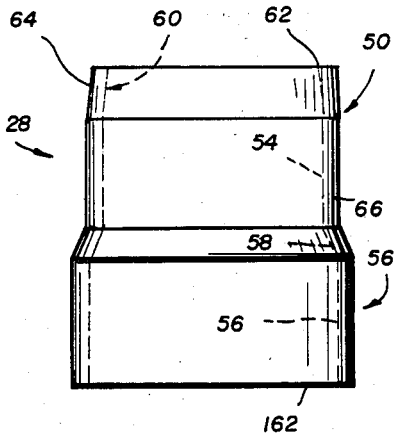
FIG. 10 is a front, elevational view of the corner section, according to the present invention.
Figure 11:
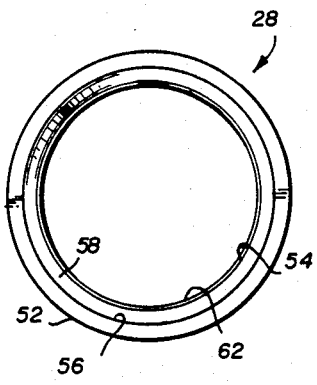
FIG. 11 is a bottom, plan view of the corner section shown at FIG. 10.
Figure 12:
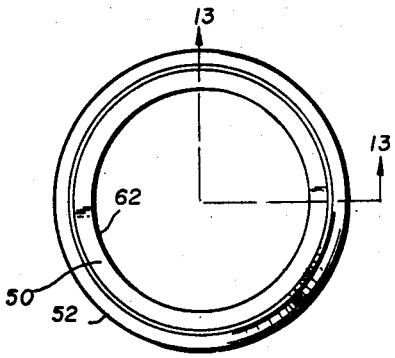
FIG. 12 is a top, plan view of the corner section shown in FIG. 10.
Figure 13:
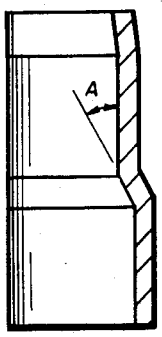
FIG. 13 is a cross-sectional view taken along the lines 13—13 of FIG. 12.

With reference now to FIGS. 3 and 4, the assembled condition of a corner support member 28 and an insert 30 are shown in FIG. 3 whereas in FIG. 4, the corner support member 28 has been raised vertically along the post 12 so that the insert member 30 is fully exposed in its position on that post. It should be noted in the assembled condition in FIG. 3, a portion of insert 30 extends above the top edge 32 of corner support member 28 so that the area between the post and the corner support member 28 is effectively sealed and so that the insert can be firmly and positively engaged by the upper end of support 28.

With reference to FIGS. 5–7, insert 30 is shown as including an internal cylindrical bore 34 and for molding purposes, this bore can have about a half a degree of relief in order to remove the internal molding structure. A radially, inwardly extending rib 36 is formed around the inner periphery of bore 34 adjacent the lower end thereof and positioned approximately in a plane located at the center of the radiused lower section 38 of the insert member.

The outer side wall above radiused section 38 indicated at 46 is also cylindrically shaped so that the inner bore 34 and the outer wall 40 are substantially parallel to one another save for the relief needed to remove the molding structure. Insert member 30 includes an upper section comprised of the cylindrical walls 40 and 34 and a lower section having a radiused exterior that extends outwardly beyond the cylindrical wall 40. The radiused of rib 36 is about 0.020 inches ±0.005 with rib having a width of about 0.040±0.010. The side wall thickness between bore 34 and side wall 40 is approximately 0.10 inches. The height of side wall 40 is approximately 1.035 inches with the height of the radiused section 38 being 0.278 inches with the radiused of that section being at 0.156 inches.

The internal bore is approximately 1 inch with the overall diameter of the insert being 1.2 inches and the diameter of the radiused section being 1.375 inches ±0.005.

In order to make the placement of the insert 30 on the post an easier task, as well as to ease its removal and movement along the post, the one piece structure is provided with a slot 42 extending along the full length of the insert member, as well cut out portions 44 and 46 positioned on each side. While the width of that slot is not critical, it typically can be on the order of 0.031 inches with the cut out portions generally defining a circle about 0.750 inches in diameter. Thus, one's fingers can be placed within cut outs 44 and 46 and the insert member can be gently pryed open along slot 42. This will relieve rib 36 from within a groove 47 provided along the post, as shown in FIGS. 3 and 4, and will allow easy movement of the insert along the post.

With reference now to FIGS. 10–13, each of the corner sections 28 is drawn preferably from flat sheet stock of steel about 0.96 inches thick. Each of the corner sections includes an upper portion generally indicated at 50, and a lower portion 52. The upper portion 50 has an internal bore generally indicated at 54 with a first predetermined dimension of about 1.23 inches. The lower portion 52 also includes an internal bore 56 having a second, predetermined diameter of about 1.395 inches. Joining these two bores is an annular, chamfered surface 58, the corners of which are preferably slightly radiused. Surface 58 is sloped at an angle A which is preferably 30°±3° from vertical. The upper portion of the first, cylindrical bore 54 is tapered inwardly, this inwardly tapered section being generally indicated at 60. This inward taper preferably ranges from about 3 to 4 degrees so that the diameter of the upper open end 62 is approximately 1.2 inches in diameter. The outer side wall of this taper section 64 can be tapered as well or can remain straight as the exterior side wall 66 of the upper section 50.

Exemplary dimensions for the corner member are approximately 1.75 inches high with the upper tapered section 64 being approximately 0.28 inches in height. The cylindrical surface 56 is approximately 0.688 inches in height.

Figure 14:
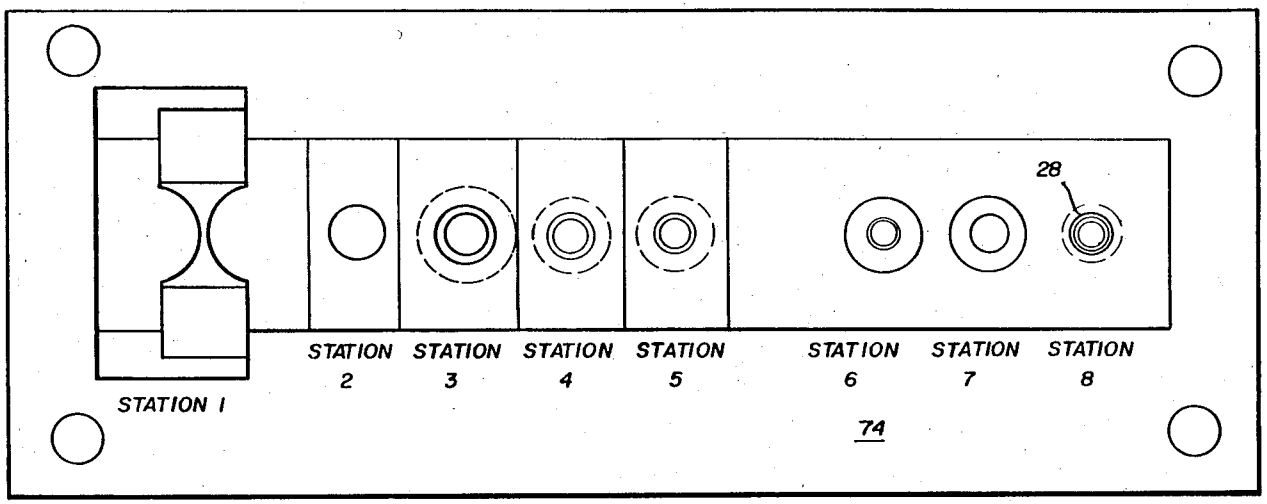
FIG. 14 is a top, plan view of the drawing steps of metal strip.
Figure 15:
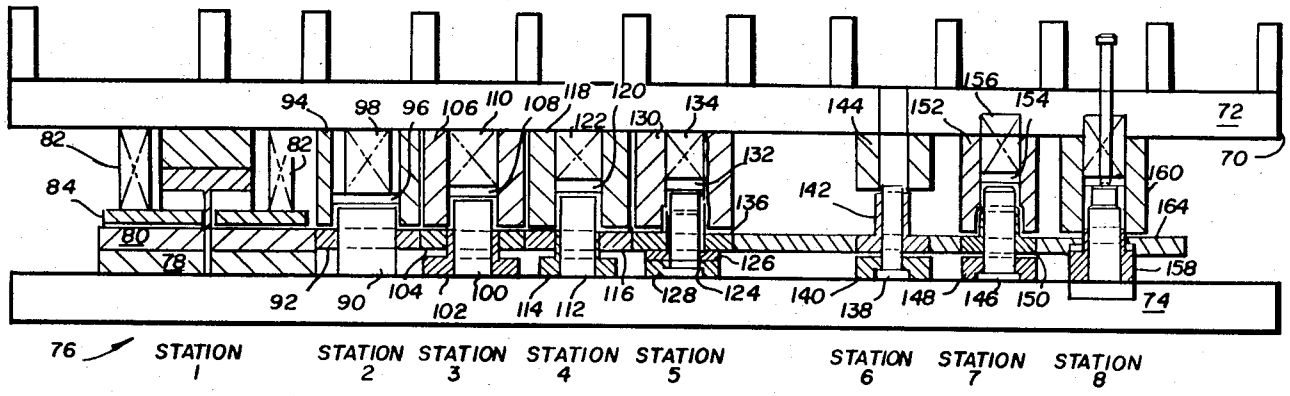
FIG. 15 is a diagrammatic side, elevational view of the progression of the drawing and shaping stations for preparing the corner section according to the present invention.

With reference to FIGS. 14 and 15, FIG. 14 shows the forming sequence for the coil strip and FIG. 15 shows the eight station, draw and shaping assembly for forming the corner sections.

The die set, generally indicated at 70, can be encompassed between upper and lower mounting structures 72 and 74 of conventional ram type press design.

With reference first to station 1, generally indicated at 76, the drawing equipment includes a retainer 78, a die 80, spring members 82, the steel coil material 84, and a punch assembly generally indicated at 86. At station 1, two half circles are cut on opposite sides of die 80, generally as indicated in FIG. 14, so that initial shaping of the blank or piece that is to be punched and drawn into the corner section is roughly formed in station 1.

Station 2 is the next station to which the blank is moved with this station including a draw punch 90, pressure plate member 92 and an upper draw die 94, as well as a KO plug 96 and a spring member 98. At station 2, the first draw will extend the previously formed blank to about 40% of its final height as shown by punch 90 operating within die 94. From here the first drawn portion will be moved to station 3 comprised of a draw punch 100, draw ring 102 and a pressure plate 104 that operate cooperatively with the upper die 106, a KO plug 108 and a spring member 110. In the second draw at station 3, the blank is drawn another 25% and thereafter the drawn blank is moved to station 4 for the third draw. Station 4 includes a draw punch 112 located below the blank together with a KO plug 114 and pressure plate 116. These cooperate with the upper draw die 118, a KO plug 120 and spring member 122. Here another 20% of the draw is added to the blank. At station 5, the next station, comprised of a size punch 124, a draw ring 126 and a retainer 128 as well as the upper sizing die 130, KO plug 132 and spring 134 and a pressure plate 136, the fourth draw adds another 15% draw. The lower section 52 of the corner section can now be seen as being formed by the operation of size punch 124 within the shaped internal portions of sizing die 130.

The formed corner member at this point still has a closed upper end and at station 6, which includes a punch 138, a retainer 140 and strip ring 142 as well as an upper die 144, the top opening 62 is formed by punch 138.

The drawn blank then moves to station 7 which includes an extruding punch 146, retainer 148, draw ring 150, an upper extruding die 152, a KO plug 154 and spring 156. At this station, the final dimensions are added both to the upper and lower sections 50 and 52 and the top angled portion including side wall 64 and internal bore 60 are shaped to their final taper of preferably to 3½ degrees, although this can range from 3–4 degrees.

The drawn corner section while now fully shaped is still connected to a portion of the coil material and at station 8, the lower punch 158 cooperates with an upper punch die 160 to sever the bottom edge 162 from the remainder of the sheet stock 164.

With reference now to FIG. 9, the corner section has been cut away and is shown in cross-section so as to show the mounted and assembled relationship between insert 30 and corner section 28. Because opening 62 at the upper end of corner section 28 is substantially identical to the outer diameter of the cylindrical side wall 40 of the insert, the upper opening 62 will circumferentially engage side wall 40. This assures there is a tight engagement at that point between the corner section and the insert and thus to the post. This firm engagement at each corner of the shelf will prevent racking and eliminate the need for any further type of bracing or support for the shelf system. It can also be seen from FIG. 9 that the internal bore 54 is spaced outwardly from side wall 40. While that distance is not critical, it is preferably about 0.15 inches [the outer diameter of insert is 1.200 inches, whereas the inner diameter of bore 54 is 1.230 inches].

Thus, there is no engagement between the internal bore 54 and the external surface 40 of the insert except for at the upper end 62.

Chamfered surface 58 lies on and engages the radiused portion 54 with the support provided by insert 30 being produced at the juncture of these two surfaces. The loading force from the shelf will be directed at this radiused portion and will be directed inwardly toward post 12 with some of the load being absorbed by rib 36. The inner diameter of the lower cylindrical bore 56 is also slightly greater than the outer diameter of radiused portion 38. Thus, both of the cylindrical walls 54 and 56 are spaced from the insert member with engagement therebetween occuring only at the upper edge 62 and along chamfered surface 58. This assures that not only is racking prevented by the engagement between the insert member and the upper opening 62 of the corner section, but provides firm and positive support between the radiused section 38 of the insert and chamfered surface 58. This arrangement can absorb large even very large loads and there is no wedging that occurs between chamfered surface 58 and the radiused portion 38. Because of the spaced apart relationship between the insert 30 and the corner section 28, that is between the cylindrical surfaces thereof, the latter can be easily raised away from the former, that is from the position shown in FIG. 3 to that shown in FIG. 4 without the necessity of employing any great deal of force.

As shown in FIGS. 5 and 9, it is preferable that the upper surface 66 of insert 30 be chamfered at approximately 45 degrees although this is not necessary.

It is preferred that the corner section be made out of steel or stainless steel although any drawable metal can be used as well. Similarly, it is preferred that the insert member 30 be formed as a one piece structure from any strong moldable material and that molding of this piece can be perfected by any conventional technique.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims, which scope is to be accorded the broadest interpretation so as to encompass all such modifications and equivalent structures.

I claim:

1. A shelf support system to mount a shelf onto support posts, said system including an inner insert member and an outer corner section, said insert member having a cylindrical interior opening extending therethrough, means within said cylindrical opening defining a radially inwardly projecting circumferential rib, said insert having an upper cylindrically shaped exterior portion and an integral radiused lower portion extending outwardly beyond said upper portion, said insert member including means defining an expansion slit extending along the full length thereof, said corner section having upper and lower generally cylindrical sections having an upper cylindrical opening with a first diameter and a lower cylindrical opening with a second larger diameter, respectively, said upper cylindrical opening having the upper end thereof angled inwardly so that the diameter of the opening at the upper end is substantially equal to, but not greater than the outer diameter of said insert member when on the post, said first and second cylindrical openings being joined by a chambered surface, said first diameter being greater than the outer diameter of said insert member, said second diameter being greater than the outer diameter of said radiused portion of said insert member, whereby when said insert member is positioned on a support post, said corner section will slide thereover until said chamfered surface rests on said radiused portion and the upper end engages the outer diameter of said insert member.

2. A shelf support system as in claim 1, wherein said insert member includes a chamfered top edge.

3. A shelf support system as in claim 1, wherein said circumferential rib is positioned so that it is located in a plane substantially equal to the center of the radiused periphery of said radiused lower portion.

4. In a shelf support system where the shelf has a hollow corner support at each corner for fitting over a support post and an insert member for fitting between the post and the corner support, the improvement comprising forming the insert member with a cylindrical internal bore and with an axially extending expansion slot together with an upper cylindrical exterior side wall portion having a predetermined outer diameter and an integrally formed radiused lower portion extending outwardly from said upper portion, and forming the interior of the corner support so that it engages and is supported by said radiused lower portion and is spaced from the upper cylindrical exterior side wall portion of said insert member, said hollow corner support further including means defining an upper opening having a diameter equal to the outer diameter of said upper cylindrical exterior side wall so that the upper opening engages said insert member to provide lateral support.

5. A shelf support system as in claim 4, wherein said insert member further includes means defining an opening extending through said upper cylindrical side wall.

6. A shelf support system as in claim 4, wherein the corner support extends downwardly beyond the radiused lower portion when supported thereon.

7. A support system for use in mounting shelving onto support posts having a plurality of spaced apart circumferentially extending grooves, said system including:

a cylindrical insert merber for fitting over the post, said insert member having a cylindrically shaped upper portion and a radiused exterior bottom portion, a radially inwardly directed rib position on the interior of said insert member, and an expansion slot extending along the full length thereof; and a member for fitting over said insert, said member having integral upper and lower cylindrical interior portions, said upper portion having an internal dimension in excess of the outer dimension of said cylindrical insert member above said radiused portion and less than the outer dimension of said radiused portion, said lower portion having an internal dimension in excess of the outer dimension of said radiused portion, a sloping surface joining said upper and lower portions for intersecting said radiused portion, and an upper edge having a dimension substantially equal to, but not greater than the outer diameter of said cylindrical insert member above said radiused portion, so that only said upper edge and said sloping surface contact said cylindrical insert member, said rib being positioned to accept at least some of the load forces developed between said sloping surface and said radiused portion.

8. A support system for mounting shelving onto vertical posts comprising a hollow cylindrical insert member having a vertically extending slot, an upper cylindrical exterior portion and a radiused lower exterior portion, and an inwardly directed rib positioned interiorly of said insert member and of said radiused portion; and an outer hollow support member, for fitting over said insert member, having upper and lower interior cylindrical surfaces, an angled surface extending between said upper and lower interior cylindrical surfaces, the upper interior cylindrical surface having an internal diameter greater than the outer diameter of the upper portion of said cylindrical insert member but less than the outer diameter of the radiused lower portion thereof, the lower interior cylindrical surface having an internal diameter greater than the outer diameter of said radiused lower portion, and an upper edge having an internal diameter substantially equal to but not greater than the outer diameter of the upper portion of said cylindrical insert member.

9. A corner support system as in claim 8, wherein said insert member includes means defining an opening extending through the upper portion of said cylindrical insert member.

10. A corner support system as in claim 8, wherein said cylindrical insert merber is integrally formed.

11. A corner support system as in claim 8, wherein said outer hollow member is integrally formed.

12. A support system for use in mounting a shelf to a plurality of support posts, said system comprising:

an integrally formed hollow insert member for fitting directly onto said support posts and having upper and lower portions, an inwardly directed rib positioned interiorly of said insert member and within said lower portion, and an expansion slot extending along the length of said insert member, an outer support member attached to said shelf for fitting over said insert member, said insert member and said outer member having means for providing contact between each other only at two spaced apart points of contact, one of said points of contant being located between the lower portion of said insert member and the outer support member so that the latter is vertically supported thereby, and the other point of contact being located between said upper portion of said insert member and said outer support member.

13. A support system as in claim 12, wherein each of said points of contact is in the form of a line.

14. A support system as in claim 12, wherein each of said points of contact extend about said insert member.

15. A support system as in claim 12, wherein said other point of contact provides lateral support to prevent racking.

16. A support system as in claim 12, wherein each of said support posts, said insert member and said outer support member have circular shaped cross-sections.

* * * * *